United States Patent [19]

Brown et al.

[11] 3,994,046

[45] Nov. 30, 1976

[54] COMPOSITE SLIVER FORMING ASSEMBLY

[75] Inventors: Roger S. Brown, New Orleans; Charles L. Shepard, Chalmette; Laurey J. Richard, Metairie, all of La.

[73] Assignee: The United States of America as represented by the Secretary of Agriculture, Washington, D.C.

[22] Filed: Aug. 14, 1975

[21] Appl. No.: 604,857

[52] U.S. Cl. ..... 19/150; 19/243

[51] Int. Cl.[2] ..... D01H 5/72

[58] Field of Search ..... 19/243, 150, 157, 145; 226/109

[56] References Cited

UNITED STATES PATENTS

| | | | |
|---|---|---|---|
| 3,266,692 | 8/1966 | Whitten | 19/157 X |

FOREIGN PATENTS OR APPLICATIONS

| | | | |
|---|---|---|---|
| 916,917 | 1/1963 | United Kingdom | 19/288 |
| 1,085,021 | 9/1967 | United Kingdom | 19/243 |

*Primary Examiner*—Dorsey Newton

*Attorney, Agent, or Firm*—M. Howard Silverstein; Salvador J. Cangemi; David McConnell

[57] ABSTRACT

Prearranged ribbons of fiber leaving the front drafting roll are superimposed into layers by a composite sliver forming assembly before entering a trumpet. The composite sliver forming assembly consists of tubular guides extending at an angle from the front drafting roller to the trumpet entrance. The tubes are designed with a flat bottom to support the sliver, allowing for overlapping at the tube exit, and to achieve an exact ribbon exit 90° downward into the trumpet entrance where the layered ribbons are combined into a composite sliver.

8 Claims, 7 Drawing Figures

FIG. 3
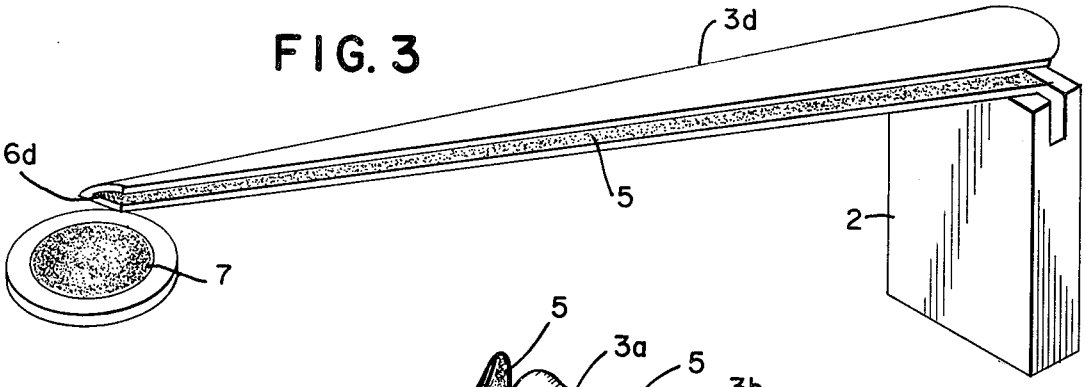
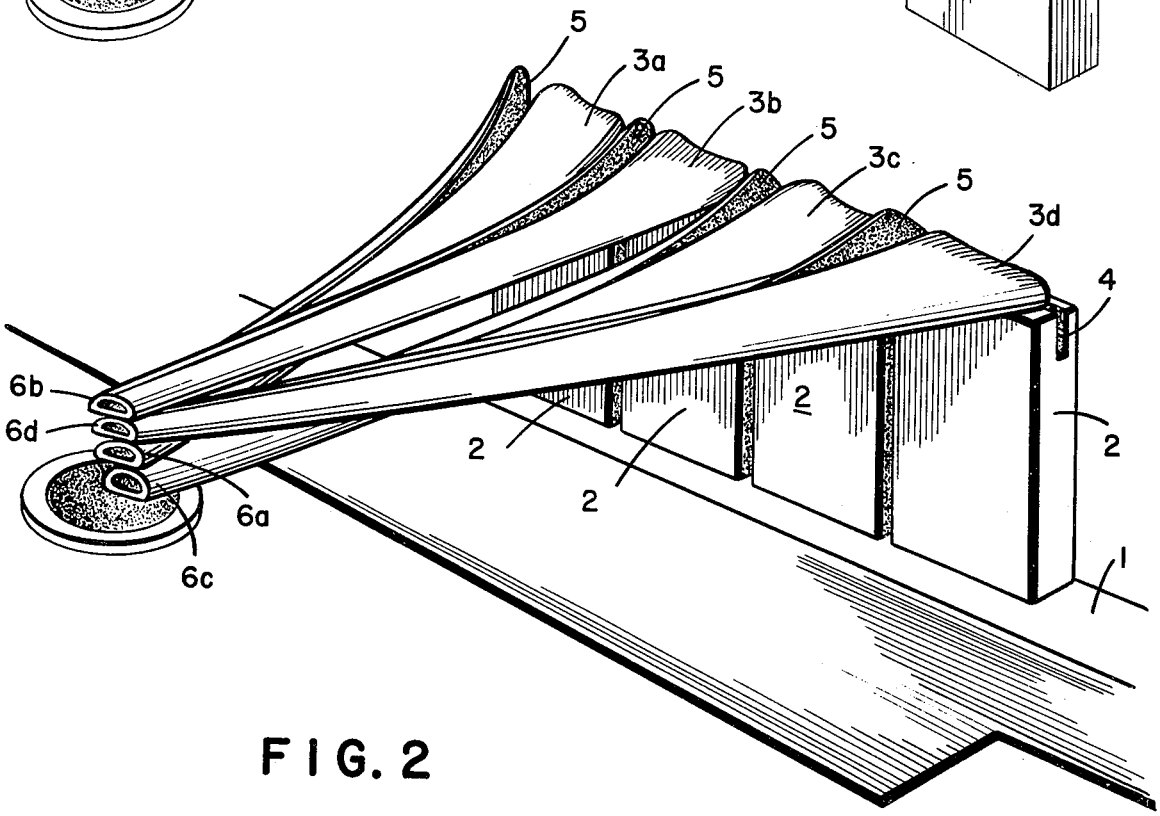
FIG. 2
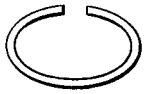
FIG. 4
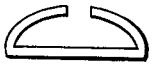
FIG. 5
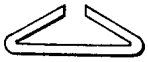
FIG. 6
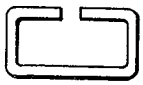
FIG. 7

COMPOSITE SLIVER FORMING ASSEMBLY

An apparatus and method for improving the homogeneity of textile fibers which are blended together in a textile drawing machine is described. More specifically, an apparatus for superimposing into layers the ribbons leaving the fron drafting roll is described.

It has been well known in the art that the blending of cotton and synthetic fibers can be initiated in either the opening or the drawing operations. The drawframe is considered the ideal location for blending cotton and manmade fibers because the most efficient processing organization for each type fiber can be utilized through carding while keeping the wastes separate. Drawframe blending, however, does have one serious objection in that the slivers do not blend homogeneously but retain their individual indentity within the output sliver. Lack of fiber homogeneity causes uneven dyeing which results in lower quality fabrics. Accordingly, it is the object of this invention to overcome the aforementioned problems and disadvantages.

Heretofore, fibers were blended by feeding slivers of different fiber side by side into the drafting rollers and combining the output into a single sliver in an uncontrolled manner. In this side by side arrangement there is no mixing or blending of the fibers in the drafting zone. Furthermore, it has long been known in the art that when you blend two different fibers, a difference in tension will exist between the different fibers causing separation of the drafted slivers while being combined into the single output sliver. These differences are the primary causes for the lack of homogeneity in the blended fibers and result in reduced quality.

Attempts have been made in the past to improve blending at the drawing frame by overlaying the slivers to be blended prior to feeding into the drafting zone. However, this produced too large a bulk of material to be handled by the back rollers with the disadvantageous result of an uneven composite sliver produced. Also it is difficult to keep the slivers aligned with each other as they pass through the drafting rollers.

Prior art also teaches that slivers were gathered by a fly control pan assembly which consisted of a single back gathering bar and a single front hollow tube which combines the web into a composite sliver and guides the sliver into the trumpet. This provided no control for fiber blended and resulted in erratic fiber composition and poor blending due to a tension differential.

Furthermore, prior art subjected the emerging slivers to very traumatic angular adjustments requiring the slivers to negotiate two 90° turns. This placed added burdens on the delicate lossely entrained fibers resulting in reduced fiber parallelization. Whereas, the instant invention eliminates the two 90° angle bends and negates the effect of the tension differential and combines the composite slivers in a controlled manner to form a single sliver in alternating layers of the component fibers being blended.

It is the principal object of this invention to provide a means through which a quality fabric can be produced.

Another object of this invention is to produce a homogeneously blended yarn.

A third object of this invention is to obtain homogenous blending by improving the drawing process.

A fourth object of the invention is to improve the homogeneous blending of different fibers by the use of a guide mechanism to overlay the different slivers after the slivers emerge from the drafting zone.

A fifth object of the invention is to eliminate a series of traumatic angular sliver turns which result in reduced fiber parallelization.

A sixth object of the invention is to negate the fiber tension differential in the conventional drawing frame apparatus.

Other objects and advantages of this invention will further become apparent hereinafter and in the drawings, in which:

FIG. 2 is an isometric view of the composite fiber forming assembly as mounted to the vertical mounting bar and details the overlapping ends at the trumpet.

FIG. 3 is another embodiment showing a side view of the hollow approximately horizontal tube indicating the slot on the side.

FIG. 4 is an exit end cross-sectional view of the hollow tube depicting the oval configuration with the slot at the top.

FIG. 5 is an exit end cross-sectional view of the hollow tube depicting the semi-circular configuration with the slot at the top.

FIG. 6 is an exit end cross-sectional view of the hollow tube depicting the triangular configuration with the slot at the top.

FIG. 7 is an exit end cross-sectional view of the hollow tube depicting the rectangular configuration with the slot at the top.

Figure 1:
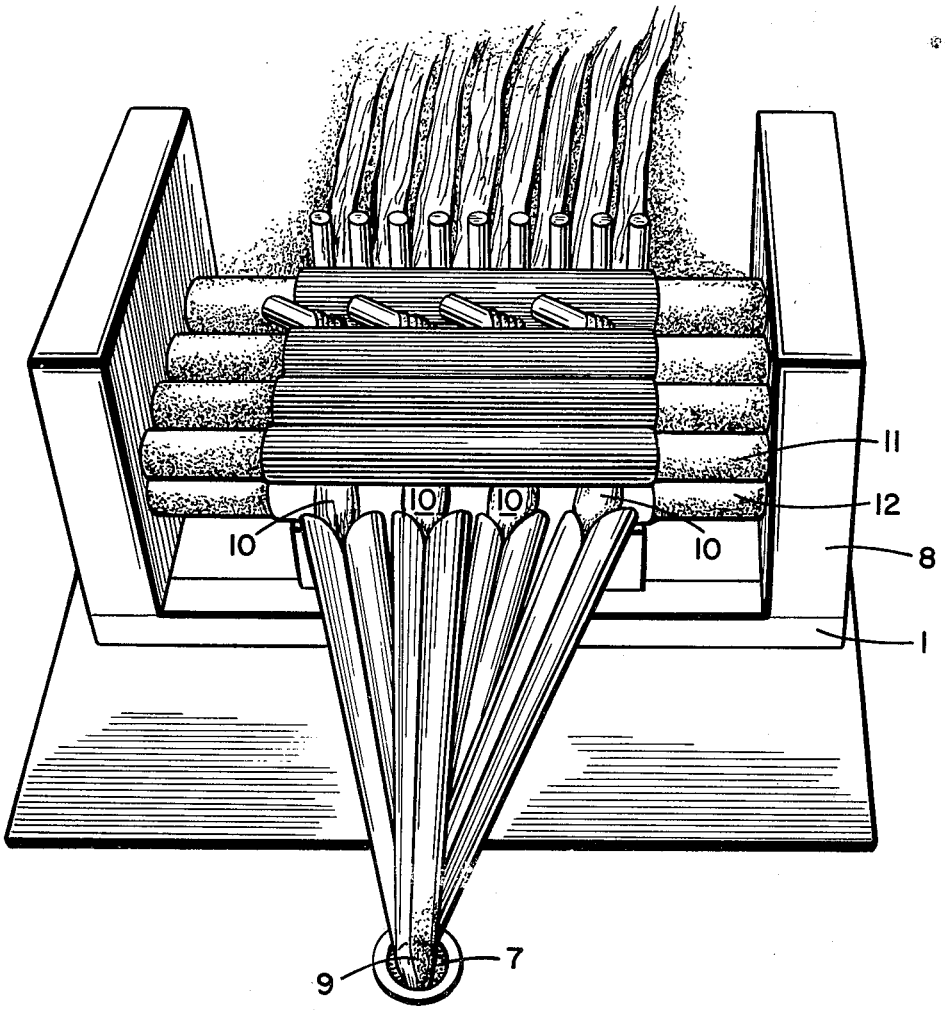
FIG. 1 is an isometric view of the composite fiber forming assembly as attached to a conventional drawing frame apparatus.

In describing the preferred embodiment of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

Turning now to the specific embodiment of the invention illustrated in the drawings, where members 11 and 12 represent the front drafting rolls of a conventional drawing apparatus. Drafting rolls 11 and 12 are mounted on vertical mounting frames 8 which are affixed to base member 1. Vertical mounting bars 2 can be affixed to base member 1 or to an independent mounting bar which would be affixed between vertical mounting frames 8.

Individual front folding tubes 3*a*, 3*b*, 3*c*, and 3*d* have a flat member (not shown) which extends from the flat bottom of the entrance end of the tubular guides downward approximately 90° with the horizontal and acts as a holding device. This flat member is designed to fit snuggly into slot 4 holding the tubular guides rigidly at the required angle to vertical mounting bars 2.

Since all the tubular guides must feed into a single trumpet 7, it imposes a design requirement that all the exit ends 6*a*, 6*b*, 6*c*, 6*d* of the tubular guides overlap to allow for proper ribbon alignment. This also imposes the additional requirement that all the tubular guides by designed to different lengths to compensate for different distances from the vertical mounting bars to the trumpet. Since the distances from the vertical mounting bars are at an angle with respect to the trumpet, the tubular guides are tapered from the entrance end to the exit end. The width of exit end 6*a*, 6*b*, 6*c*, 6*d* are determined by the width of ribbon 10.

To achieve optimum superimposing of ribbon which will result in the most homogenous blend of fibers, it is mandatory that exit ribbons 10 exactly overlay each other. Therefore, the overlay of the ends of the tubular guides is critical in design due to the fact that ribbons 10 must exit the tubular guides and enter the trumpet at approximately a 90° angle. In the development of the instant invention it was determined that for ribbon 10 to remain flat and to follow the centerline of the tube the exit ends 6*a*, 6*b*, 6*c*, 6*d* must be constructed 90° with respect to said centerline.

Ribbons 10 are threaded through the tubular guides by means of threading slot 5 located in the top of tubular guides 3*a*, 3*b*, 3*c*, and 3*d*. Threading slot 5 runs the full length of the top of the tubular guides. the threading operation can be accomplished by threading from the entry end to the exit end and the ribbons will slide in between the stacked exit ends because the exit ends are not rigidly fixed. Ribbons 10 are then combined into a composite sliver and fed into trumpet 7 in a conventional manner.

Tubular guides 3*a*, 3*b*, 3*c*, and 3*d*, can be fabricated to any configuration. The cross section of the tubular guide can take the form of a rectangle, an oval, a triangle, a semi-circle, etc., or a combination of these. It cannot be circular since it is possible for the sliver to disorient and fold back on itself. However, the instant invention was fabricated as a flat base triangle with rounded sides, opened at the top and tapered in height and width from the entrance to the exit end.

In the case of the instant invention, the entrance end was flared at the open top to allow for ease of threading. However, the opening which forms threading slot 5 can be either at the top or sides.

As a result of this invention substantial improvements were made in the blending of fibers. Individual ribbons can now be overlapped into a layered composite sliver in which no two adjacent layers are of the same fiber components, thus producing a more homogeneous blend.

It is to be understood that the fibers to be blended using this apparatus can be any combination of fibers both natural and synthetic.

We claim:

1. A composite sliver forming assembly for the blending of fibers installed in a conventional drawframe and comprising in combination:

a. a set of hollow approximately horizontal, juxtaposed, tapered tubes, each tube individually comprising:
   1. an open entrance end to receive a single sliver;

2. a slot substantially the full length of said tube for initial sliver threading;
   3. an open exit end, each said exit end of said tube overlapping with respect to the other to produce exact sliver overlay;

b. a vertical mounting bar supporting the entrance end of each said tube;

c. a means of affixing said tube entrance end to said vertical mounting bar;

d. a single horizontal mounting bar forming a base for support for said vertical mounting bars and;

e. two frames rigidly supporting said horizontal mounting bar base.

2. The apparatus as defined in claim 1 wherein the slot of the individual hollow, approximately horizontal, tapered tubes are flared at the entrance end thereof to allow for ease of sliver threading.

3. The apparatus defined in claim 1 wherein the means of affixing the hollow, approximately horizontal, tapered tubes to the vertical mounting bars is comprised of:

a. a flat member extending downward at approximately 90° with the horizontal;

b. a slot located in the top center of the vertical mounting bar into which said flat member is inserted, said slot comprising:
   1. depth and width determined by the outside dimension of the thickness and width of the said flat member.

4. The apparatus as defined in claim 1 wherein the hollow, horizontal, tapered tubes are configuratively designed as a flat base triangle with rounded sides, opened at the top, and tapered in height and width from the entrance to the exit end.

5. The apparatus as defined in claim 1 wherein the cross-section of the hollow, approximately horizontal, tapered tubes takes the configuration of a rectangle.

6. The apparatus as defined in claim 1 wherein the cross-section of the hollow, approximately horizontal, tapered tubes takes the configuration of a semi-circle.

7. The apparatus as defined in claim 1 wherein the cross-section of the hollow, approximately horizontal, tapered tubes takes the configuration of an oval.

8. The apparatus as defined in claim 1 wherein the hollow, approximately horizontal, tapered tubes have a slot opening located along the side of the said tubes, substantially the full length thereof.

* * * * *